US006048052A

United States Patent [19]

Kitahara et al.

[11] Patent Number: 6,048,052

[45] **Date of Patent: *Apr. 11, 2000**

[54] INK JET RECORDING HEAD

[75] Inventors: Tsuyoshi Kitahara; Minoru Usui; Takahiro Naka; Osamu Nakamura; Tatsuya Seshimo, all of Nagano, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/013,646

[22] Filed: Feb. 4, 1993

[30] Foreign Application Priority Data

| | | | |
|---|---|---|---|
| Feb. 7, 1992 | [JP] | Japan | 4-022831 |
| Oct. 8, 1992 | [JP] | Japan | 4-270560 |
| Jan. 12, 1993 | [JP] | Japan | 5-019668 |

[51] Int. Cl.[7] ..... B41J 2/045

[52] U.S. Cl. ..... 347/70; 347/47

[58] Field of Search ..... 346/140, 75; 347/70, 347/68, 47, 40

[56] References Cited

U.S. PATENT DOCUMENTS

| | | | |
|---|---|---|---|
| 4,459,601 | 7/1984 | Howkins | 346/140 |
| 4,475,113 | 10/1984 | Lee | 346/140 X |
| 4,564,846 | 1/1986 | Siegal | 346/75 |
| 4,611,219 | 9/1986 | Sugitani et al. | 346/140 |
| 4,680,595 | 7/1987 | Cruz-Uribe et al. | 346/140 |
| 4,905,017 | 2/1990 | Sugitani | 346/140 X |
| 5,446,485 | 8/1995 | Usui | 347/72 |

FOREIGN PATENT DOCUMENTS

| | | | |
|---|---|---|---|
| 443628 | 8/1991 | European Pat. Off. | B41J 2/045 |
| 3208104 | of 0000 | Germany | B41J 3/10 |
| 357212074 | 12/1982 | Japan | B41J 3/04 |
| 359209882 | 11/1984 | Japan | B41J 3/04 |

OTHER PUBLICATIONS

Lee et al; Laminated Ink Jet Head; IBM Tech. Disc. B., V23, N7A, Dec. 1980, pp. 2955–57.

IBM Tech. Disc. Bulletin; Drop–on–Demand Nozzle Interlace pattern, V28, Ni, Jun. 1985, pp. 65–67.

*Primary Examiner*—Joseph Hartary

*Attorney, Agent, or Firm*—Sughrue, Mion, Zinn, Macpeak & Seas, PLLC

[57] ABSTRACT

In an ink recording head having at least four nozzle opening rows, each row having nozzle openings so as to extend straightly in a sheet forward direction, the nozzle opening rows are staggered by a single dot in the sheet forward direction in an order different from the physically arranged order. The maximum distance between nozzle opening rows to print vertically adjacent dots becomes smaller by L1 or L2 than at least the physical maximum distance L1+L3+L2, L1 or L2 being a distance between the outermost nozzle opening row and the inner nozzle opening row. As a result, the relative displacement in the vertical direction can be reduced by such distance L1 or L2 compared with a recording head in which nozzle opening rows are sequentially staggered in the auxiliary scanning direction in the physically arranged order.

3 Claims, 7 Drawing Sheets

INK JET RECORDING HEAD

BACKGROUND OF THE INVENTION

1. Field of the Invention

The invention relates to an ink jet recording head having at least four rows of nozzle openings in a main scanning direction with each row having a plurality of nozzle openings in a sheet forward direction. From such ink jet recording head, ink droplets are jetted out by pressure produced by pressure producing sources using piezoelectric elements, heating elements or the like.

2. Related Art

What has been proposed to improve dot density for better print quality is an arrangement in which four rows of nozzle openings extend in the carriage moving direction, i.e., in the main scanning direction. Such a nozzle arrangement is usually implemented by two sets of a recording head that has two rows, the nozzle openings in each row being staggered by a single dot in the sheet forward direction.

However, the second and third nozzle opening rows that are adjacent to each other in the middle are separated from each other by a housing forming member, and this not only increases the distance between the rows, but also requires an ink supply means. In addition, the operation of aligning the two heads is cumbersome as well.

Proposed to overcome the above problems is an integrated ink jet recording head in which four or more nozzle opening rows are arranged on a common nozzle plate and each nozzle opening has a pressure producing chamber thereof.

As shown in FIG. 10, such an integrated ink jet recording head is characterized as staggering the nozzle opening of each of the nozzle opening rows A, B, C, D by a single dot in the physically arranged order.

In this recording head, after driving the nozzle opening rows A, B, C, D in the physically arranged order, the nozzle opening rows are driven again cyclically in such physically arranged order. Thus, the carriage moves by a distance L1+L2+L3, which is the distance between the outermost rows, until the fourth nozzle opening row D printing a dot adjacent to the dot printed by the first nozzle opening A is driven. As a result, any inclination of the ink jet recording head accurring at the time of mounting the head or a change in the head mounting angle caused by play aggravates fluctuations in the distance between the dots printed by other nozzle opening rows, thereby impairing print quality.

SUMMARY OF THE INVENTION

The invention has been made in view of the above circumstances. Accordingly, the object of the invention is to provide an ink jet recording head capable of reducing relative displacement of dots among a plurality of nozzle opening rows to a smallest possible level.

To achieve the above object, the invention is applied to an ink jet recording head that includes four or more rows of nozzle openings in a main scanning direction. Each row has a plurality of nozzles so as to extend straightly in a sheet forward direction at a pitch corresponding to the number of rows of nozzle openings.

In such an ink jet recording head, the nozzle opening rows are staggered in the auxiliary scanning direction by a predetermined pitch so that the order of their arrangement is different from the physically arranged order. As a result, the maximum distance between adjacent nozzle opening rows to print vertically adjacent dots becomes smaller by a distance between the adjacent nozzle opening rows than at least the physical maximum distance, thus contributing to reducing relative displacement in the vertical direction by a distance equivalent to the distance between the adjacent nozzle opening rows compared with a head in which nozzle opening rows are sequentially staggered in the auxiliary scanning direction in the physically arranged order.

DESCRIPTION OF THE PREFERRED EMBODIMENTS

Embodiments of the invention will be described in detail with reference to the accompanying drawings.

Figure 1:
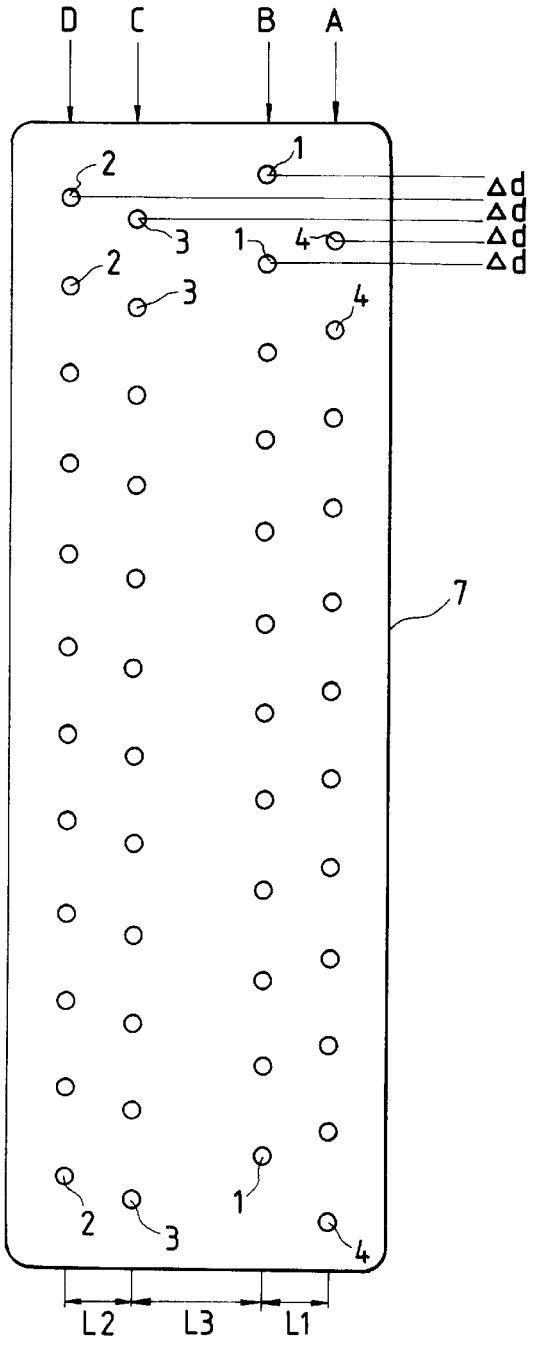
FIG. 1 is a diagram showing an ink jet recording head, which is an embodiment of the invention, in the form of nozzle opening arrangement.

FIG. 1 shows an embodiment of the invention. In FIG. 1, reference numeral 7 designates a nozzle plate having four rows of nozzle openings A, B, C, D. The pitch between nozzle openings 1, 1 . . . , 2, 2 . . . , 3, 3 . . . , or 4, 4 . . . , each being arranged linearly on each of the rows B, D, C, A, is four times a pitch between vertically adjacent dots, i.e., $\Delta d \times 4$. The first nozzle opening row A that is located outermost and the second nozzle opening row B that is adjacent thereto, as well as the third nozzle opening row C and the fourth nozzle opening row D that is adjacent thereto are arranged at smallest possible distances L1 and L2, whereas the second and third nozzles B, C are arranged at such a distance L3 as to allow a vibrating element unit (later described) to be accommodated. As shown in FIG. 1, each row of nozzle openings is selected so that the second row B, the fourth row D, the third row C, and the first row A stagger one another in a sheet forward direction at a distance equal to a single dot ($\Delta d$) in the written order.

Figure 2:
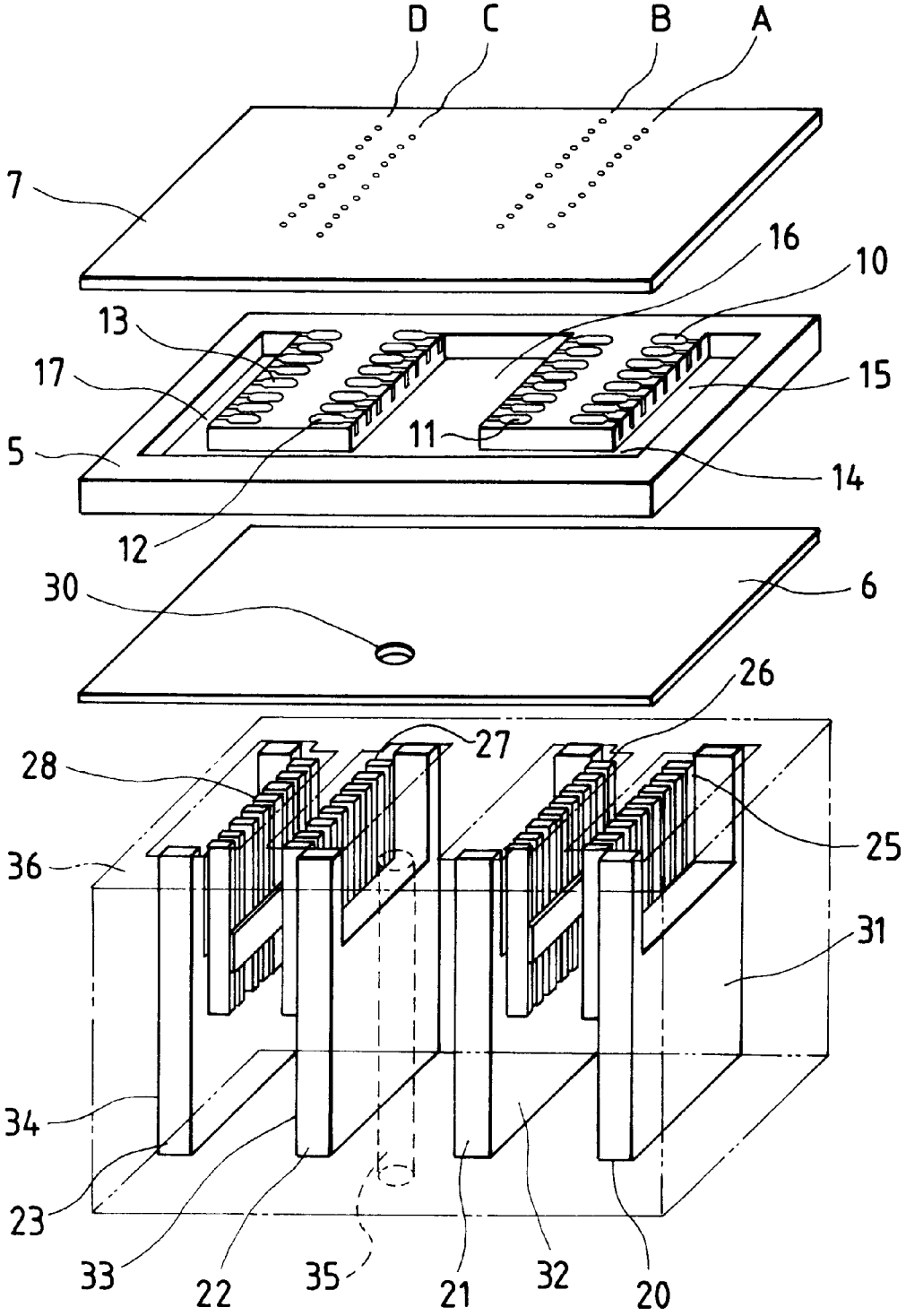
FIG. 2 is an exploded perspective view showing the ink jet recording head shown in FIG. 1.
Figure 3:
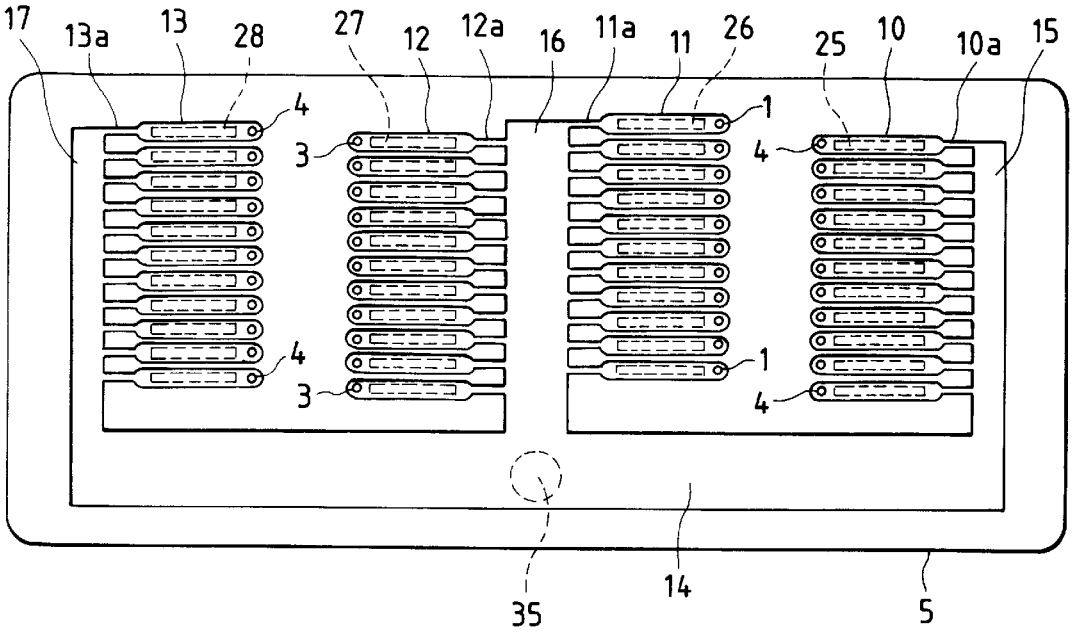
FIG. 3 is a diagram showing the ink jet recording head shown in FIG. 1 with a nozzle plate thereof removed.

FIG. 2 shows a structure of the ink jet recording head having the above-mentioned nozzle opening arrangement. In FIG. 2, reference numeral 5 designates a spacer interposed between the nozzle plate 7 and a vibrating plate 6 (described later) so as to form an ink flow path. As shown in FIG. 3, not only rows of throughholes 10, 10, 10 . . . , 11, 11 11 . . . , 12, 12, 12 . . . , 13, 13, 13 . . . that will serve as pressure producing chambers at a pitch corresponding to the pitch at which the nozzle openings 1, 1, 1 . . . , 2, 2, 2 . . . , 3, 3, 3 . . . , 4, 4, 4 . . . of the respective rows of nozzle openings B, D, C, A are arranged, but also a throughhole 14 that will serve as an ink flow path for supplying ink to the pressure producing chambers from a tank is provided. The throughholes 10, 10, 10 . . . , 11, 11, 11 . . . , 12, 12, 12 . . . , 13, 13, 13 . . . that will serve as pressure producing chambers are formed so as to confront the nozzle openings 4, 4, 4 . . . , 1, 1, 1 . . . , 3, 3, 3 . . . , 2, 2, 2 . . . of the respective rows of nozzle openings A, B, C, D at an end thereof. And the throughholes 10, 10, 10 . . . and the throughholes 13, 13, 13 . . . , both located outermost of the nozzle plate 7, include communicating recessed portions 10*a*, 10*a*, 10*a*, . . . , 11*a*, 11*a*, 11*a* . . . , 12*a*, 12*a*, 12*a* . . . , 13*a*, 13*a*, 13*a* . . . , each communicating recessed portion being formed in a size slightly smaller than the throughhole.

In FIG. 2, reference numeral 14 designates the throughhole that will serve as an ink supply path for receiving ink from the tank through a supply inlet 30. It is so designed that the throughhole 14 communicates with throughholes 15, 16, 17 which will serve as reserve tanks, the throughholes 15, 16, 17 communicating with the throughholes 10, 10, 10 . . . , 11, 11, 11 . . . , 12, 12, 12 . . . , 13, 13, 13 . . . , and the communicating recessed portions 10*a*, 10*a*, 10*a* . . . , 11*a*, 11*a*, 11*a* . . . , 12*a*, 12*a*, 12*a* . . . , 13*a*, 13*a*, 13*a* . . . . As a result, the pressure producing chambers for the nozzle opening rows A, D that are located outermost of the nozzle plate 7 receive ink from the independent reserve tanks, whereas the nozzle opening rows B, C located in the middle receive ink from the common reserve tank, which is the throughhole 16.

Reference numeral 6 designates the above-mentioned vibrating plate, which is made of an elastic plate for partitioning the pressure producing chambers, the ink supply path, the reserve tanks formed on the spacer 5 from vibrating units 20, 21, 22, 23. The vibrating plate 6 comes in contact with ends of piezoelectric vibrating elements 25, 25, 25 . . . , 26, 26, 26 . . . , 27, 27, 27 . . . , 28, 28, 28 . . . to transmit vibration produced by the vibrating elements 25, 26, 27, 28 to the pressure producing chambers. At a position confronting the ink supply path is the throughhole 30 so that an end of an ink supply pipe 35 communicates with the throughhole 14 that will form the ink supply path.

Reference numerals 20, 21, 22, 23 designate the above-mentioned vibrating element units. Ends of the vibrating elements 25, 26, 27, 28 are mounted on fixed plate 31, 32, 33, 34 so that the vibrating element units confront the pressure chambers of the respective rows of nozzle openings. To mount the units 20, 21 as well as 22, 23 mounted on the first and second rows of nozzle openings A, B as well as the third and fourth rows of nozzle openings C, D, the fixed plates 31, 32, 33, 34 are mounted on a frame 36 so that the respective vibrating elements confront each other.

Figure 4:
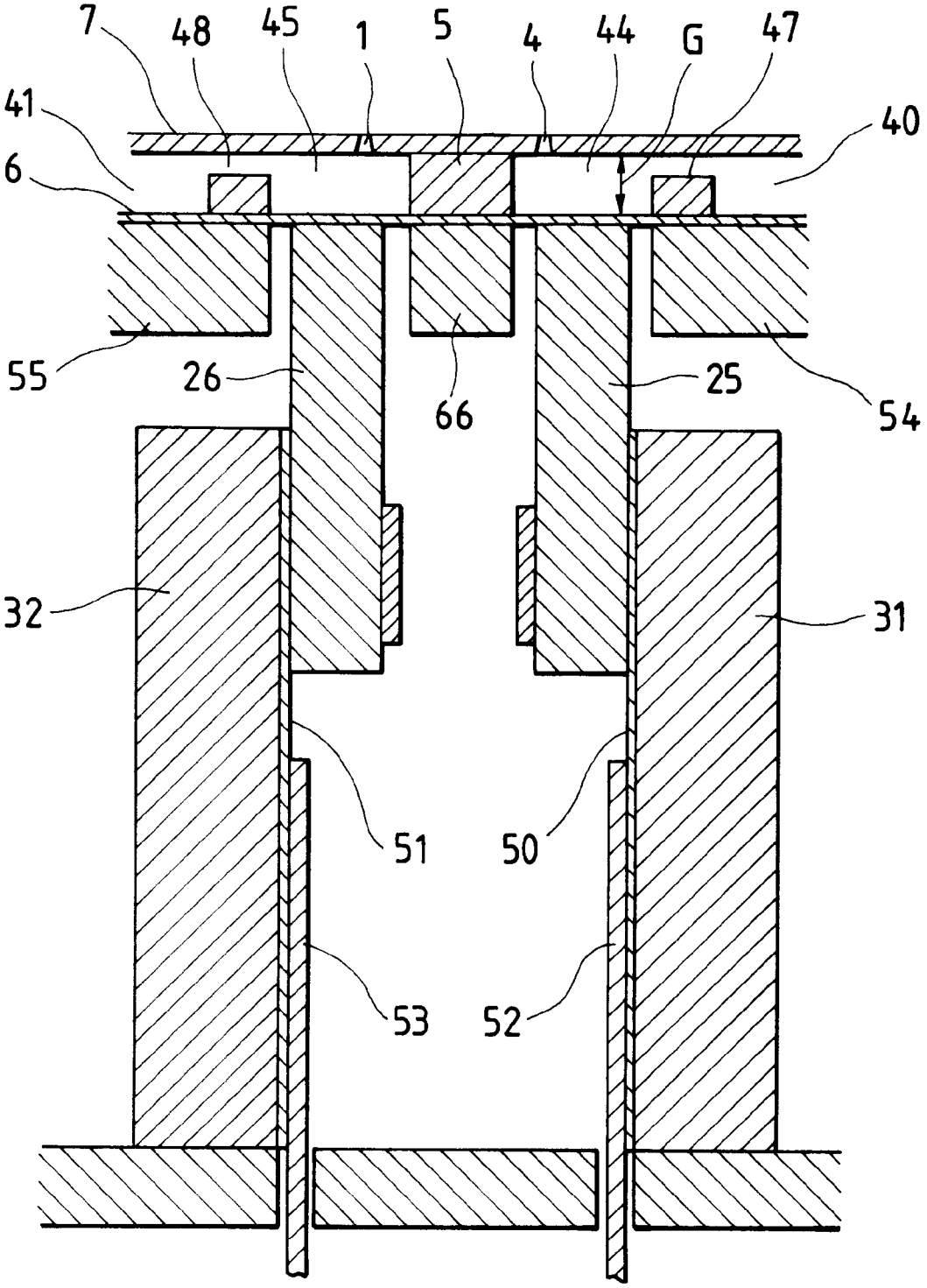
FIG. 4 is a diagram showing a sectional structure of the ink jet recording head shown in FIG. 1.

FIG. 4 shows a sectional structure of the above-mentioned ink jet recording head. A predetermined gap G is provided between the vibrating plate 6 and the nozzle plate 7 by the spacer 5. Reserve tanks 40, 41, . . . , pressure producing chambers 44, 45, . . . , communicating flow paths 47, 48 . . . are formed of the throughholes 15, 16, 17 and the recessed portions 10*a*, 10*a*, 10*a* . . . , 11*a*, 11*a*, 11*a* . . . , 12*a*, 12*a*, 12*a*, 13*a*, 13*a*, 13*a* . . . , of the spacer 5. The ends of the vibrating elements 25, 26 of the vibrating units 20, 21 abut against the vibrating plate 6 in such a manner as to confront the pressure producing chambers 44, 46, respectively. These vibrating elements 25, 25, . . . , 26, 26, . . . are designed so that a drive signal can be applied thereto by cables 52, 53 through an electrically conductive patterns 50, 51. Reference numerals 54, 55, and 66 designate reinforcing members for supporting the vibrating element 6.

Figure 6:
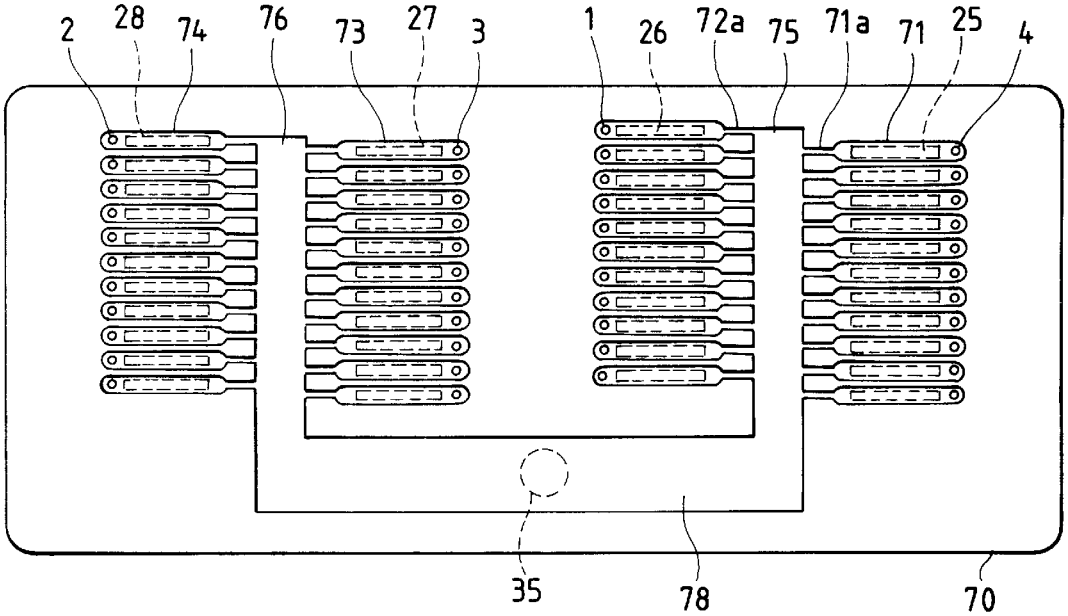
FIG. 6 is a diagram showing the ink jet recording head shown in FIG. 5 with a nozzle plate thereof removed.
Figure 5:
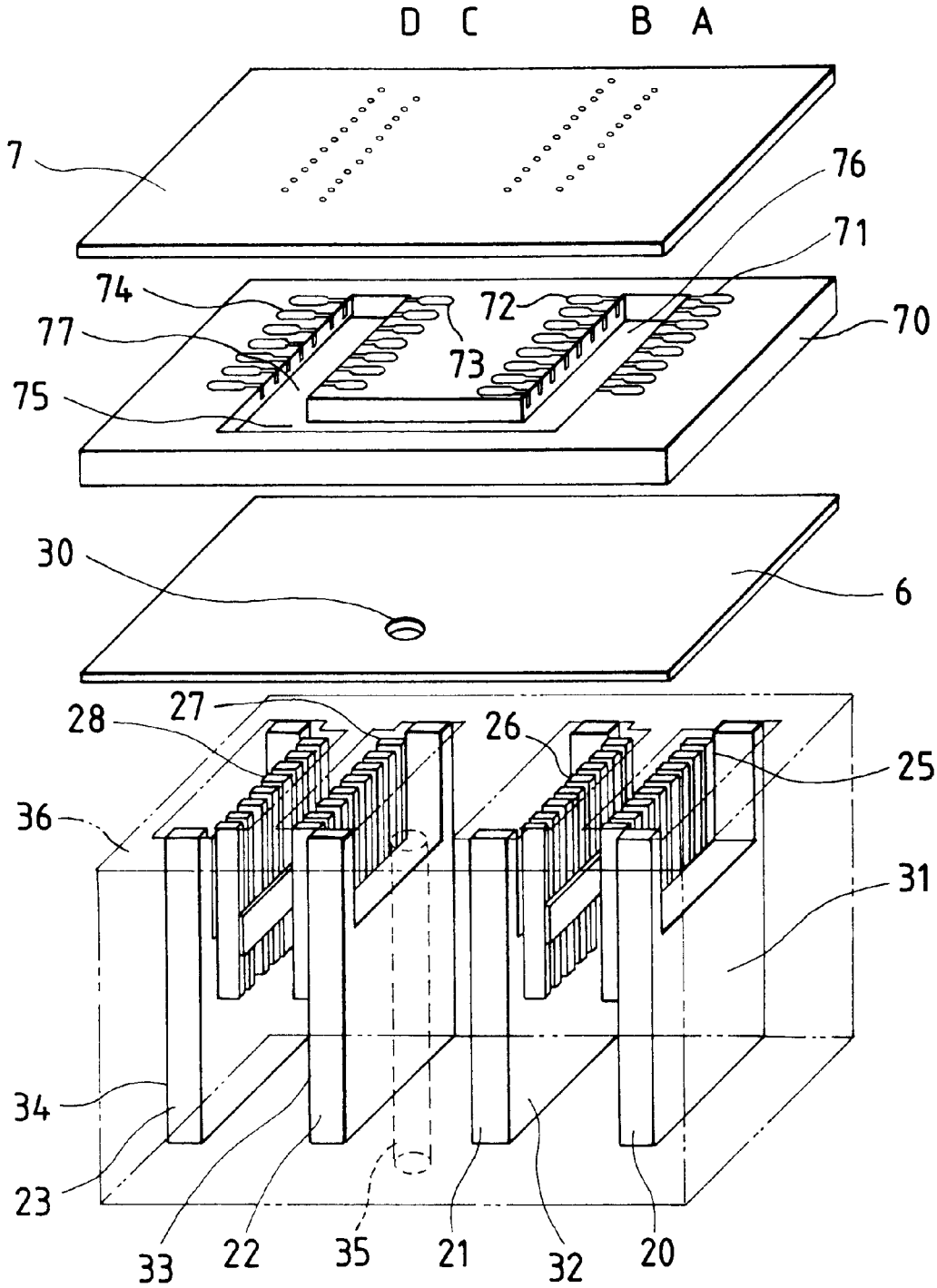
FIG. 5 is an exploded perspective view showing ink flow paths in an ink jet recording head, which is another embodiment of the invention.

FIGS. 5 and 6 show an ink supply path, which is another embodiment of the invention. In FIGS. 5 and 6, reference numeral 70 designates a spacer. In this embodiment throughholes 71, 71, 71 . . . , 72, 72, 72 . . . as well as throughholes 73, 73, . . . , 74, 74, 74 . . . , which will become pressure producing chambers, formed on the first nozzle opening row A and the second nozzle opening row B as well as the third nozzle opening row C and the fourth nozzle opening row D, are arranged so that the ink supply ports of the throughholes 71, 71, 71 . . . . or of the throughholes 73, 73, . . . confront those of the throughholes 72, 72, 72 . . . or of the throughholes 74, 74, . . . . In addition, communicating recessed portions 71*a*, 71*a*, 71*a* . . . , 72*a*, 72*a*, 72*a* . . . , 73*a*, 73*a*, 73*a* . . . , 74*a*, 74*a*, 74*a* . . . connected to throughholes 75, 76 that will serve as reserve tanks are formed on the side that will become the ink supply path.

According to this embodiment, an ink supply path portion can be shared in common by the two nozzle opening rows, thereby achieving a simple flow path design.

In this embodiment, when the first nozzle opening row A has reached a predetermined position, a drive signal is applied to the vibrating elements 25, 25, 25 . . . corresponding to dots to be printed by nozzle openings 4, 4, 4 . . . that belong to the first nozzle opening row A. As a result, ink droplets are jetted out of the nozzle openings 4, 4, 4 . . . to form the dots on a recording sheet (not shown). When the recording head has moved by a distance equal to L1+1 dot by the carriage, a drive signal is applied to the vibrating elements 26, 26, 26 . . . corresponding to dots to be printed by the second nozzle opening row B. As a result, the dots are formed in a row one dot staggered in the main scanning direction from the previously printed dots.

Further, when the carriage has moved by a distance equal to L3+1 dot, dots are formed by driving the third nozzle opening row C; and when the carriage has moved by a distance equal to L2+1 dot, dots are formed by driving the fourth nozzle opening row D.

Upon end of printing a single line while moving the ink jet recording head in the main scanning direction, the recording sheet is forwarded by a single line before printing a next line. For the second line, printing is started when the first nozzle opening row has reached a predetermined position. The same processes as in the printing of the first line are sequentially followed to print desired dots.

By the way, the dots printed by the respective nozzle opening rows are produced by causing the carriage to move by a distance (L3+L2) or (L1+L3), which is a distance L1 or L2 shorter than the distance (L1+L2+L3) between the outermost nozzle opening rows. In other words, the carriage moving distance is saved compared with the conventional carriage moving distance (L1+L2+L3).

Figure 7A:
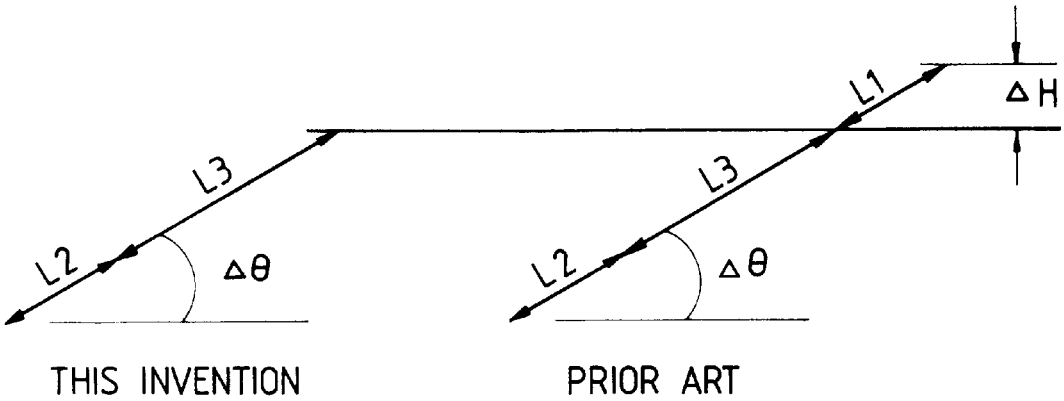
FIGS. 7(*a*) and 7(*b*) are diagrams illustrative of inter-dot relative errors caused by the ink jet recording head of the invention and those of a conventional ink jet recording head.
Figure 7B:
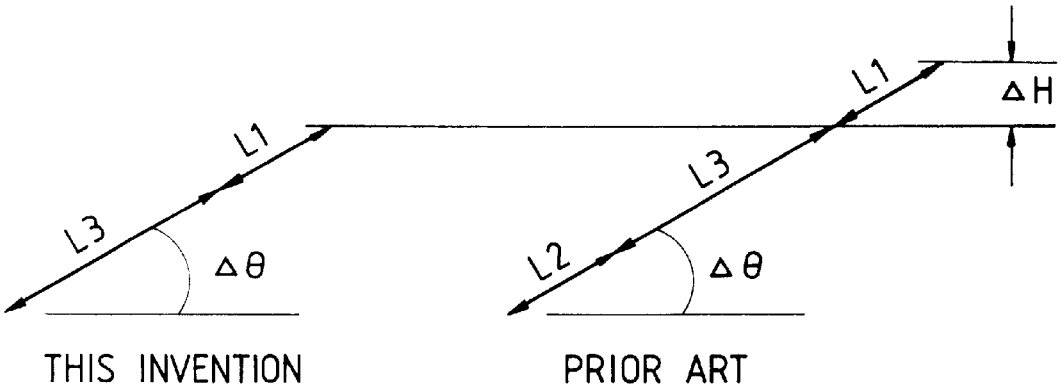

As a result, even if the ink jet recording head would be mounted while inclined by an angle θ, a gap error between two vertically arranged dots becomes smaller by ΔH compared with the conventional art as shown in FIG. 7(*a*) or 7(*b*), thus allowing print quality to be improved. Since the distance between the nozzle opening row including the nozzle openings that printed the lowermost of a last line and the nozzle opening row including the nozzle openings that will print the uppermost of the next line is shorter by L1 or L2 compared with the conventional example, vertical displacement of the lowermost and uppermost dots between the lines becomes short even if the recording head is mounted while inclined by the angle Δ, thereby achieving improvement in the print quality, particularly, graphic data.

Further, to print dots by taking one dot out in the auxiliary scanning direction such as in draft printing; e.g., dots are printed by using the nozzle opening row A and the nozzle opening row D, or by using the nozzle opening row B and the nozzle opening row C, a space almost as large as a single dot is produced between two vertically adjacent dots, thus making vertical displacement of the dots generally conspicuous. However, since the distance between the nozzle opening rows is shorter by L1 or L2 compared with the conventional example as described above, the error in the distance between the vertically adjacent dots can be made shorter for the same reason, thus allowing high quality draft printing to be achieved.

Figure 8:
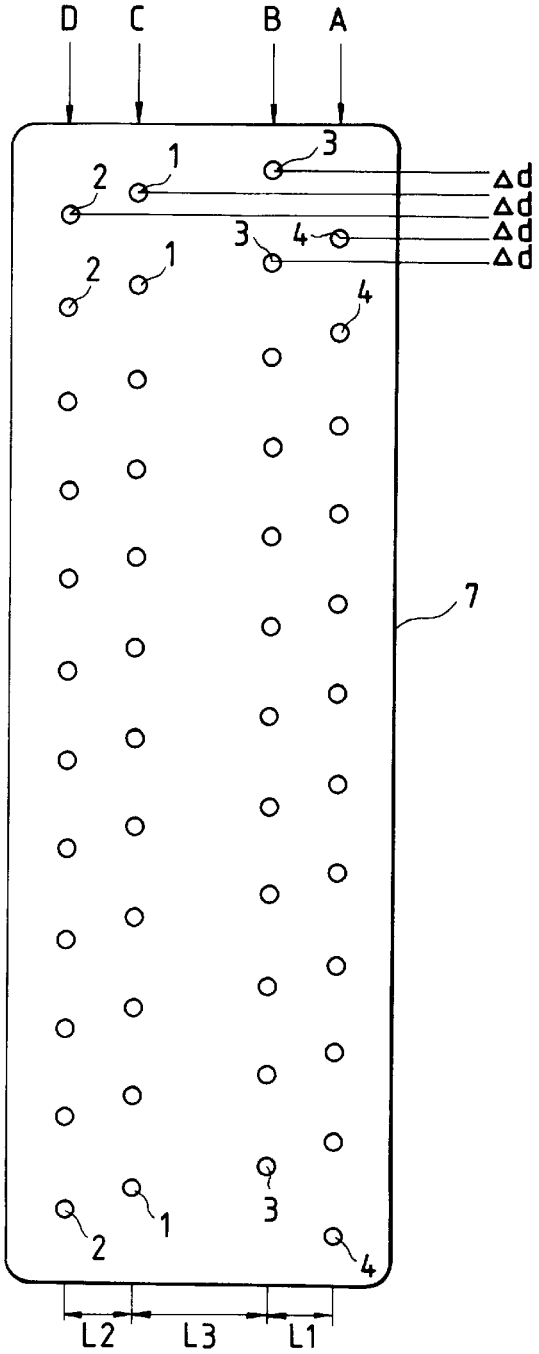
FIG. 8 is a diagram showing an ink jet recording head, which is still another embodiment of the invention, in the form of nozzle opening arrangement.
Figure 9:
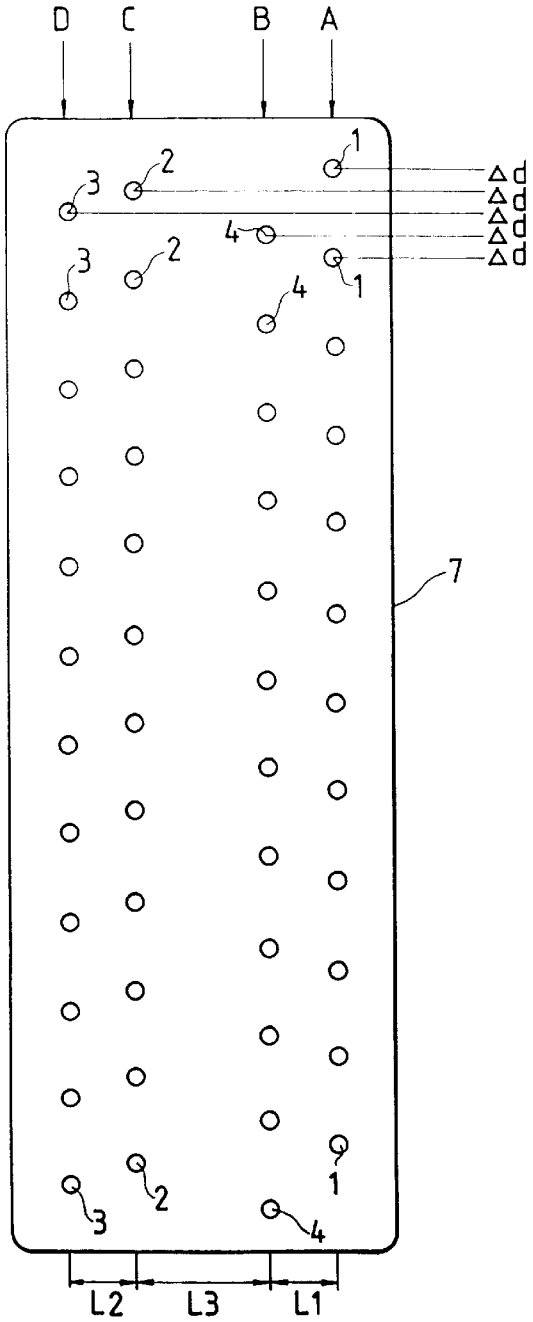
FIG. 9 is a diagram showing an ink jet recording head, which is still another embodiment of the invention, in the form of nozzle opening arrangement.
Figure 10:
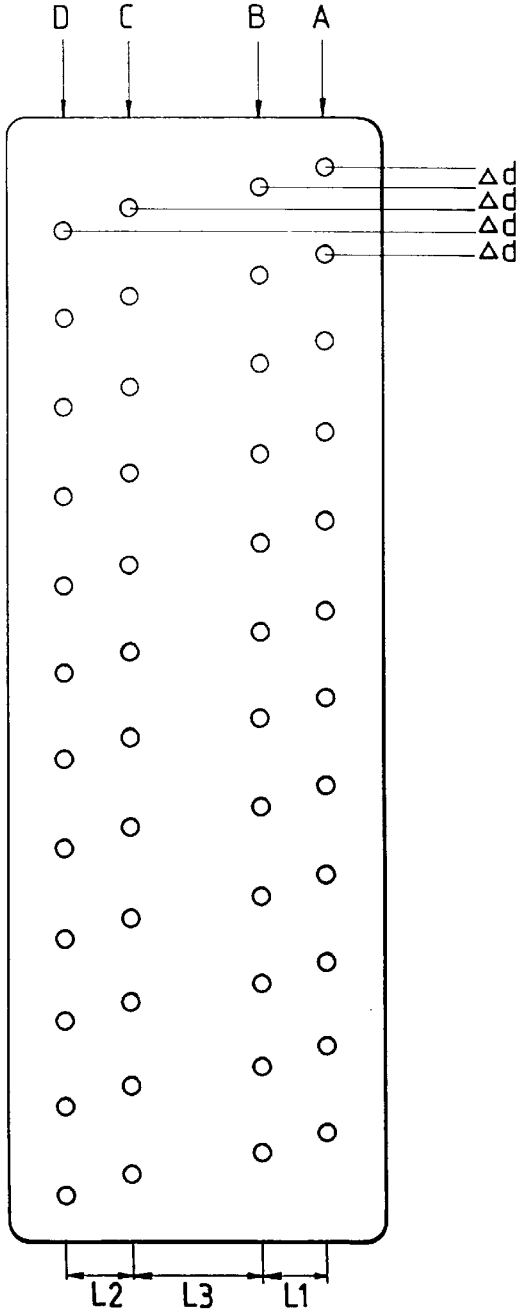
FIG. 10 is a front view showing a nozzle opening arrangement of the conventional ink jet recording head having four rows of nozzle openings.

FIGS. 8 and 9 show other embodiments in the form of nozzle opening row arrangement. FIG. 8 shows an embodiment in which the second row B, the third row C, the fourth row D, and the first row A are staggered by a single dot in the auxiliary scanning direction in the order written, whereas FIG. 9 shows an embodiment in which the first row A, the third row C, the fourth row D, and the second row B are staggered by a single dot in the auxiliary scanning direction in the order written.

The same applies to these embodiments. More specifically, the distance of a nozzle opening row to be driven in the main scanning direction is shorter by L1 or L2 than the distance (L1+L2+L3) between the outermost nozzle opening rows, so that relative displacement between dots in the auxiliary scanning direction caused by the inclination of the ink jet recording head can be reduced.

While the example in which the pitch in the auxiliary scanning direction is set to a single dot to simplify the description in the above embodiments, it goes without saying that the same advantage can be obtained by setting the pitch to a multiple of an integer or a reciprocal of such multiple. Further, the same advantage can be obtained by applying a recording head having five or more nozzle opening rows.

In the above-described embodiments, the example of a head using the vibrating elements as a pressure generating source was described. However, the nozzle arrangement of this invention is also applicable to a head in which heating elements are disposed in each of pressure generating chambers formed in an ink flow passage.

As described in the foregoing pages, the ink jet recording head, which includes at least four rows of nozzle openings straightly in the main scanning direction with each nozzle opening row having a plurality of nozzle openings in the sheet forward direction arranged at a pitch corresponding to the number of nozzle opening rows, is characterized as staggering the positions of the nozzle opening rows in the auxiliary scanning direction by a single dot so that the order of their arrangement is different from the physically arranged order. As a result, the maximum distance between the nozzle opening rows to print vertically adjacent dots becomes smaller by a distance between the adjacent nozzle opening rows than the physical maximum distance. This makes the relative displacement in the vertical direction attributable to any inclination of the ink jet recording head smaller than the arrangement in which nozzle opening rows are sequentially staggered in the auxiliary scanning direction in the physically arranged order. As a result, print quality can be improved. The invention is particularly beneficial when applied to a printing pattern in which a long distance between vertically arranged dots is conspicuous, such as in draft printing in which a single dot is thinned out.

What is claimed is:

1. An ink jet recording head, comprising:

a nozzle plate into which a plurality of nozzle openings are formed:

means for supplying an ink;

a plurality of pressure producing chambers each communicating with said plurality of nozzle openings correspondingly for supplying a pressure to said ink supplied from said ink supply means to jet said ink from said nozzle openings;

pressure producing chamber forming members, contacting said nozzle plate and disposed between said pressure producing chambers, for defining said pressure producing chambers;

a vibrating plate, contacting said pressure producing chamber forming members and disposed a predetermined distance from said nozzle plate, an upper surface of said vibrating plate defining bottoms of said pressure producing chambers; and reinforcing members, disposed on a lower surface of said vibrating plate, for reinforcing said vibrating plate, at least one of said reinforcing members corresponding to said pressure producing chamber forming members, wherein said plurality of nozzle openings comprise at least four rows of nozzle openings arranged in a main scanning direction, said rows being arranged in groups, each group comprising a pair of adjacent rows, a first space between adjacent rows of the same pair being smaller than a second space between adjacent rows of different pairs, each row having a plurality of nozzle openings so as to extend straightly in a sheet forward direction at a pitch corresponding to the number of nozzle opening rows, and the rows of nozzle openings in an auxiliary scanning direction are staggered at a certain pitch so that an order of arrangement of the rows of nozzle openings is different from the physically arranged order, and wherein said pressure producing chamber forming members are disposed beneath said nozzle plate between adjacent rows of the same pair, said ink jet recording head further comprising vibrator elements, each having one end in contact with said vibrator plate and respectively arranged beneath said pressure producing chambers; and fixed plates for providing support to said vibrator elements, wherein each row of vibrator elements is supported by a corresponding fixed plate.

2. An ink jet recording head as claimed in claim 1, further comprising a common reserve tank with which said pressure producing chambers for two adjacent rows of nozzle openings communicate.

3. An ink jet recording head, comprising:

a nozzle plate into which a plurality of nozzle openings are formed:

means for supplying an ink;

a plurality of pressure producing chambers each communicating with said plurality of nozzle openings correspondingly for supplying a pressure to said ink supplied from said ink supply means to jet said ink from said nozzle openings;

pressure producing chamber forming members, contacting said nozzle plate and disposed between said pressure producing chambers, for defining said pressure producing chambers;

a vibrating plate, contacting said pressure producing chamber forming members and disposed a predetermined distance from said nozzle plate, an upper surface of said vibrating plate defining bottoms of said pressure producing chambers; and reinforcing members, disposed on a lower surface of said vibrating plate, for reinforcing said vibrating plate, at least one of said reinforcing members corresponding to said pressure producing chamber forming members, wherein said plurality of nozzle openings comprise at least four rows of nozzle openings arranged in a main scanning direction, each row having a plurality of nozzle openings so as to extend straightly in a sheet forward direction at a pitch corresponding to the number of nozzle opening rows, and the rows of nozzle openings in an auxiliary scanning direction are staggered at a certain pitch so that an order of arrangement of the rows of nozzle openings is different from the physically arranged order, and wherein said pressure producing chamber forming members are disposed beneath said nozzle plate between adjacent rows of the same pair, said ink jet recording head further comprising a plurality of vibrating units having:

a plurality of vibrating elements including a row of the vibrating elements;

a fixed plate, to which one end of each of the vibrating elements is fixed; and a vibrating plate, with which the other end of each of the vibrating elements is in contact, wherein the rows of the vibrating elements in the adjacent vibrating units confront each other.

* * * * *